US006765184B2

(12) United States Patent
Yang

(10) Patent No.: US 6,765,184 B2
(45) Date of Patent: Jul. 20, 2004

(54) SMOKE GUIDING APPARATUS OF WALL-MOUNTED MICROWAVE OVEN

(75) Inventor: Ha-Yeong Yang, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/314,167

(22) Filed: Dec. 9, 2002

(65) Prior Publication Data

US 2004/0016754 A1 Jan. 29, 2004

(30) Foreign Application Priority Data

Jul. 26, 2002 (KR) ..... 10-2002-0044211
Jul. 26, 2002 (KR) ..... 10-2002-0044212

(51) Int. Cl.[7] ..... H05B 6/80
(52) U.S. Cl. ..... 219/757; 219/400; 126/299 R
(58) Field of Search ..... 219/757, 400, 219/391; 126/21 A, 299 R, 299 D

(56) References Cited

U.S. PATENT DOCUMENTS 3,356,008 A * 12/1967 Simpson et al. ..... 126/299 D
4,502,375 A * 3/1985 Hignite et al. ..... 454/56
4,784,114 A * 11/1988 Muckler et al. ..... 126/299 E
6,093,922 A * 7/2000 Kim ..... 219/757

FOREIGN PATENT DOCUMENTS

JP 5-118601 * 5/1993
KR 1997-11181 7/1997

* cited by examiner

*Primary Examiner*—Philip H. Leung
(74) *Attorney, Agent, or Firm*—Staas & Halsey LLP

(57) ABSTRACT

A smoke guiding apparatus of a wall-mounted microwave oven. A driving circuit of the smoke guiding apparatus includes limit switches which are turned on or off according to a moving position of a guide plate of the smoke guiding apparatus, a relay coil which is supplied with power in response to an exhaust motor of the microwave oven being operated, and a plurality of relay switches which are turned on or off by the supply of power to the relay coil. The driving circuit is implemented without using a conventional micro-computer. Accordingly, the entire manufacturing cost of the microwave oven is reduced. The instant smoke guiding apparatus can be applied to mechanical microwave ovens which are not provided with microcomputers. Furthermore, the driving circuit can drive a smoke guiding apparatus having an AC feed motor, as well as a DC feed motor, thus enabling the AC feed motor to be applied to the smoke guiding apparatus.

25 Claims, 4 Drawing Sheets

SMOKE GUIDING APPARATUS OF WALL-MOUNTED MICROWAVE OVEN

CROSS-REFERENCE TO RELATED APPLICATION

This application claims the benefit of Korean Patent Application No. 2002-44211 filed on Jul. 26, 2002 and Korean Patent Application No. 2002-44212 filed on Jul. 26, 2002 in the Korean Intellectual Property Office, the disclosures of which are incorporated herein by reference.

BACKGROUND OF THE INVENTION

1. Field of the Invention

The present invention relates to wall-mounted microwave ovens, and more particularly to a smoke guiding apparatus of a wall-mounted microwave oven, which guides smoke generated therebelow to an exhaust path of the microwave oven.

2. Description of the Related Art

Generally, a wall-mounted microwave oven is installed on a wall surface, above an oven range, and functions as a hood to suck steam and smoke generated from food cooked therebelow, and discharge them to the outside of a cooking area.

FIG. 1 shows the construction of a smoke guiding apparatus of a conventional wall-mounted microwave oven.

Referring to FIG. 1, a body 1 of the wall-mounted microwave oven includes a cooking chamber (not shown) to cook food therein and a machine room (not shown) which stores various machine parts. The cooking chamber and the machine room are partitioned from one another. The body 1 of the microwave oven further includes an exhaust fan 3 which is installed in an upper portion of a back of the body 1 so as to exhaust gas or smoke generated from an oven range 2, which is positioned below the body 1. An exhaust inlet (not shown) is formed in a lower portion of the body 1 so as to suck the gas or smoke where the exhaust fan 3 is operated. An exhaust path 4 is formed within the body 1 to guide the gas or smoke sucked into the exhaust inlet to the exhaust fan 3.

Moreover, a smoke guiding apparatus 5 is installed beneath the body 1 so as to guide the smoke therebelow to the exhaust inlet. The smoke guiding apparatus 5 comprises a limit switch 8, a feed motor 9 and a microcomputer 10. The limit switch 8 is provided to be turned on or off according to a moving position of a guide plate 7. The guide plate 7 is inserted into a guide groove of a guide member 6 to move straight forward and backward. The feed motor 9 moves the guide plate 7 by rotating forwardly or reversely in response to a control signal output from the microcomputer 10.

The microcomputer 10 controls forward/reverse rotation of the feed motor 9, or stops the rotation of the feed motor 9 in response to an output signal of the limit switch 8. In a gear shaft of the feed motor 9, a pinion gear 12 engages with a rack gear 11 formed beneath the guide plate 7, thus enabling the guide plate 7 to move forward and backward according to the rotation of the feed motor 9. For example, two grooves are formed in the guide plate 7 in a progress direction of the guide plate 7. The limit switch 8 is constructed to output different output signals according to positions of a moving surface and the two grooves of the guide plate 7.

In the conventional smoke guiding apparatus 5, the microcomputer 10 reads an output signal of the limit switch 8, and controls the feed motor 9 based upon the output signal, thus allowing the guide plate 7 to move to a guide position or an initial position (original position) of the guide plate 7.

However, the conventional smoke guiding apparatus 5 is problematic in that it increases the entire manufacturing cost thereof by employing the microcomputer 10. Further, it cannot be applied to mechanical microwave ovens which do not employ a microcomputer.

SUMMARY OF THE INVENTION

Accordingly, an aspect of the present invention is to provide a driving circuit, which is not additionally provided with a microcomputer to control a smoke guiding apparatus of a microwave oven. The driving circuit drives the smoke guiding apparatus through limit switches which are turned on or off according to a moving position of a guide plate of the smoke guiding apparatus, a relay coil which is supplied with power where an exhaust motor is operated, and a plurality of relay switches which are turned on or off by the supply of the power to the relay coil.

Another aspect of the present invention is to provide a driving circuit, which drives a smoke guiding apparatus of a microwave oven where a DC feed motor is applied to the smoke guiding apparatus.

Yet another aspect of the present invention is to provide a driving circuit, which drives a smoke guiding apparatus of a microwave oven where an AC feed motor is applied to the smoke guiding apparatus.

Additional aspects and advantages of the invention will be set forth in part in the description which follows and, in part, will be obvious from the description, or may be learned by practice of the invention.

To achieve the above and/or other aspects of the present invention, there is provided an embodiment of the present invention which includes a controller for a smoke guiding apparatus of a wall-mounted microwave oven having an exhaust motor which discharges smoke therebelow to the outside of the wall-mounted microwave oven, a guide plate which guides the smoke, and a feed motor which moves the guide plate between an initial position and a guide position of the guide plate, the controller comprising a switching unit which supplies power to the feed motor so as to move the guide plate between the guide position and the initial position in conjunction with an operation of the exhaust motor, a first limit switch which shuts off the power supplied to the feed motor in response to the guide plate reaching the guide position, and a second limit switch which shuts off the power supplied to the feed motor in response to the guide plate reaching the initial position.

To achieve the above and/or other aspects of the present invention, there is provided another embodiment of a controller for a smoke guiding apparatus of a wall-mounted microwave oven having an exhaust motor which discharges smoke therebelow to the outside of the wall-mounted microwave oven, a guide plate which guides the smoke, and a feed motor which receives DC power and moves the guide plate between an initial position and a guide position of the guide plate, the controller comprising a switching unit which supplies the DC power to the feed motor so as to move the guide plate between the guide position and the initial position in conjunction with an operation of the exhaust motor, a first limit switch which shuts off the DC power supplied to the feed motor in response to the guide plate reaching the guide position, and a second limit switch which shuts off the DC power supplied to the feed motor in response to the guide plate reaching the initial position.

To achieve the above and/or other aspect of the present invention, there is provided yet another embodiment of the present invention which includes a smoke guiding apparatus of a wall-mounted microwave oven having an exhaust motor which discharges smoke therebelow to the outside of the wall-mounted microwave oven, and a guide plate which guides the smoke, the smoke guiding apparatus comprising a feed motor which receives AC power and moves the guide plate to an initial position or a guide position of the guide plate, a switching unit which supplies the AC power to the feed motor so as to move the guide plate to the guide position in response to the exhaust motor being operated, and supplies the AC power to the feed motor so as to move the guide plate to the initial position in response to the operation of the exhaust motor being stopped, a first limit switch which shuts off the AC power supplied to the feed motor in response to the guide plate reaching the guide position, and a second limit switch which shuts off the AC power supplied to the feed motor in response to the guide plate reaching the initial position.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE EMBODIMENTS

Figure 1:
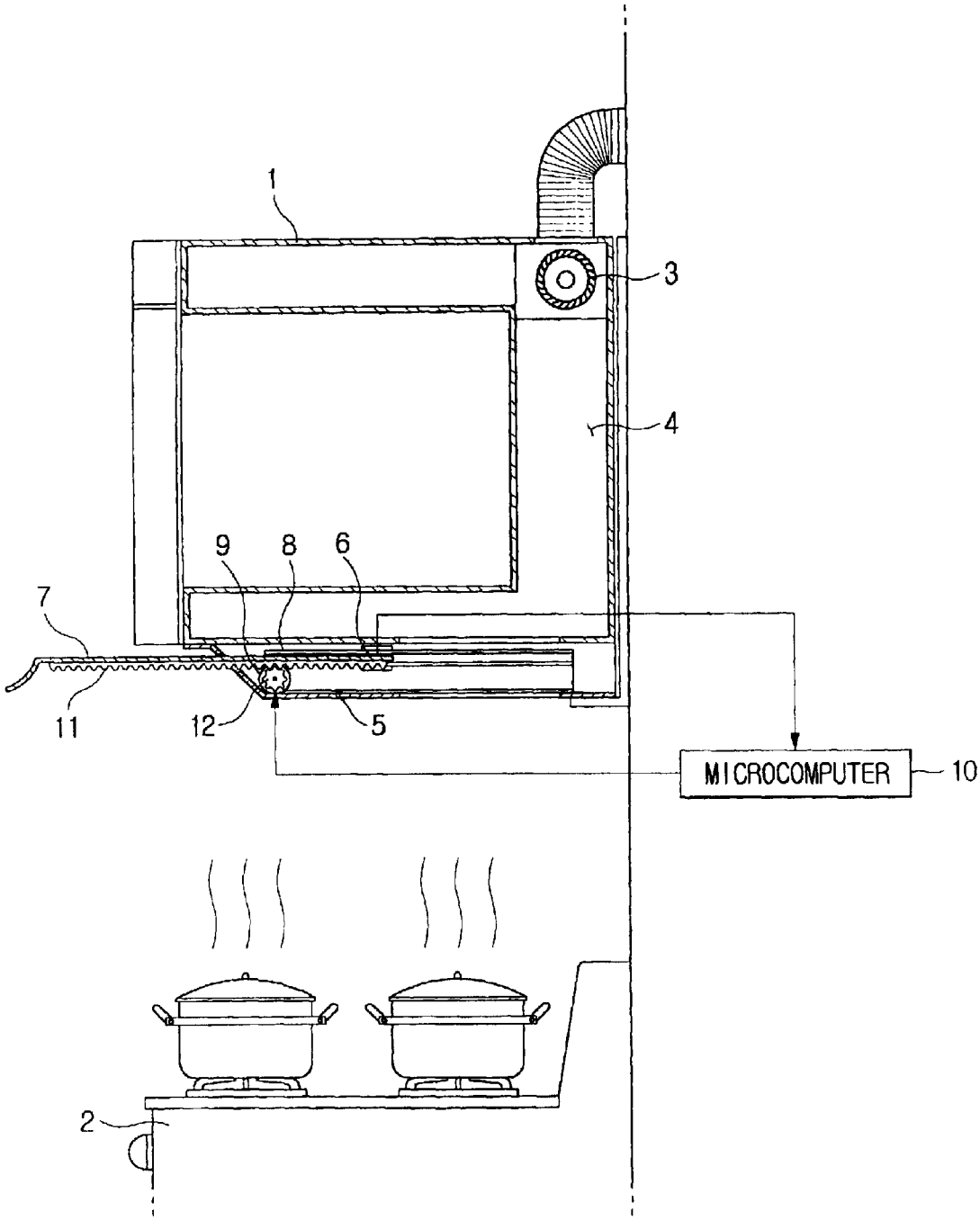
FIG. 1 (PRIOR ART)
FIG. 1 is a side view illustrating the construction of a smoke guiding apparatus of a conventional wall-mounted microwave oven.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
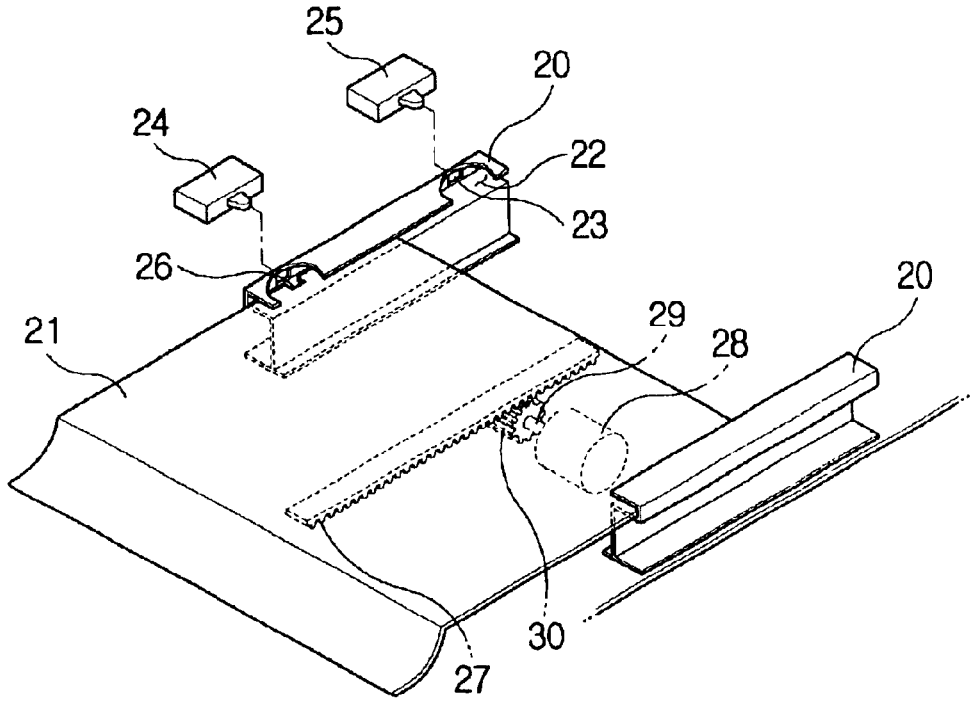
FIG. 2 is a perspective view illustrating the construction of a smoke guiding apparatus of a wall-mounted microwave oven according to an embodiment of the present invention.

FIG. 2 shows the construction of a smoke guiding apparatus of a wall-mounted microwave oven according to the present invention. As shown in FIG. 2, the smoke guiding apparatus includes guide members 20 having corresponding guide grooves 22. The guide grooves 22 are formed in a longitudinal direction to allow a guide plate 21 to slide forward and backward. In one of the guide members 20, two holes 23 are formed beside the respective guide groove 22. First and second limit switches 24 and 25, which respectively sense an initial position and a guide position of the guide plate 21 are installed so as to have their terminals inwardly project through the corresponding holes 23. In this case, the first limit switch 24 is a normal open-type switch which is turned on in response to its terminal being pressed, and is turned off in response to its terminal not being pressed. The second limit switch 25 is a normal close-type switch which is turned off in response to its terminal being pressed, and is turned on in response to its terminal not being pressed.

A sensing groove 26 is formed on a side of the guide plate 21 which comes into contact with the guide member 20 having the holes 23. Accordingly, the terminal of the first limit switch 24 is projected and inserted into the sensing groove 26 where the guide plate 21 reaches the guide position, thus allowing the first limit switch 24 to be turned off. Where the guide plate 21 presses the terminal of the second limit switch 25 at the initial position, the second limit switch 25 is turned off. Where the guide plate 21 moves to the guide position from the initial position, the terminal of the second limit switch 25 is projected to its normal position, thus enabling the second limit switch 25 to be turned on.

A rack gear 27 is formed beneath the guide plate 21. The rack gear 27 engages with a pinion gear 30 connected to a driving shaft 29 of the feed motor 28 to move the guide plate 21 to the guide position or the initial position, according to a rotating direction of the driving shaft 29.

Figure 3:
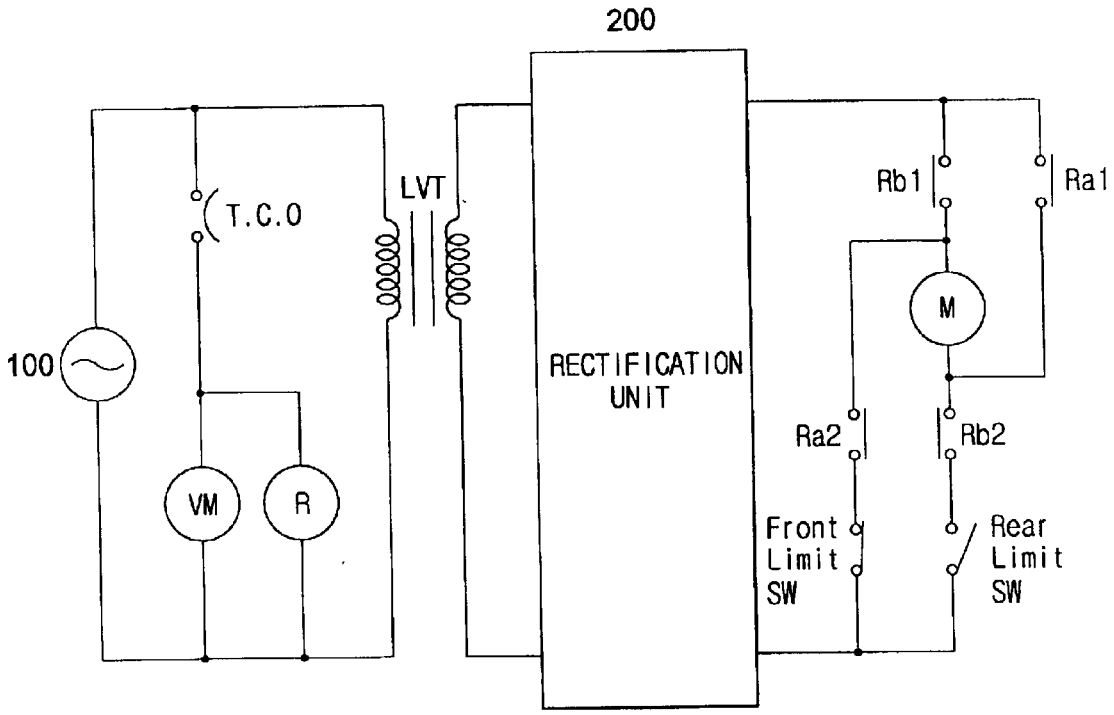
FIG. 3 is a circuit diagram of a driving circuit of a smoke guiding apparatus having a DC feed motor in a wall-mounted microwave oven according to another embodiment of the present invention.

FIG. 3 shows a circuit diagram of a driving circuit of a smoke guiding apparatus having a DC feed motor in a wall-mounted microwave oven according to an embodiment of the present invention.

As shown in FIG. 3, one end of a thermostat T.C.O, which is turned on in response to a temperature of smoke generated therebelow, i.e., while food is cooked by an oven range, being equal to or greater than a predetermined temperature, is connected to an external alternating current (AC) power source 100. The other end of the thermostat T.C.O is connected to an exhaust motor VM. The exhaust motor VM receives the external AC power in response to the thermostat T.C.O being turned on, and causes the smoke to be sucked into an exhaust path of the microwave oven, so as to discharge the smoke to the outside of the microwave oven. The exhaust motor VM is connected in parallel with a relay coil R. The relay coil R receives the external AC power in response to the thermostat T.C.O being turned on, and turns corresponding relay switches Ra1, Rb1, Ra2 and Rb2 on or off.

A low voltage transformer LVT, which decreases an external AC voltage level to a predetermined voltage level, is connected to lines branched from both ends of the external AC power source 100. A rectifying unit 200, which converts the AC power into DC power, is connected to both ends of the low voltage transformer LVT.

The relay switch Rb1, that is, a first relay contact B switch Rb1, is disposed between one end of the rectifying unit 200 and a positive (+) input terminal of the feed motor M. The first relay switch Rb1 is turned on in a normal condition and switched to a turned-off state in response to power being supplied to the relay coil R. The relay switch Ra1, that is, a first relay contact A switch Ra1, is disposed between one end of the rectifying unit and a negative (−) input terminal of the feed motor M. The first relay switch Ra1 is turned off in a normal condition and switched to a turned-on state in response to the power being supplied to the relay coil R.

The relay switch Ra2, that is, a second relay contact A switch Ra2, is branched from the first relay switch Rb1 and the positive (+) input terminal of the feed motor M, connected in series with a first limit switch FRONT SW, which senses a guide position of the guide plate 21, and connected to the other end of the rectifying unit 200.

The relay switch Rb2, that is, a second relay contact B switch Rb2, is branched from the first relay switch Ra1 and the negative (−) input terminal of the feed motor M, connected in series with a second limit switch REAR SW, which senses an initial position of the guide plate 21, and connected to the other end of the rectifying unit 200.

Hereinafter, an operation of the driving circuit of the smoke guiding apparatus shown in FIG. 3 will be described in detail.

Where a temperature of smoke generated from food, i.e., where an oven range positioned below the microwave oven is used, is equal to or greater than a predetermined temperature, the thermostat T.C.O is turned on. Accordingly, the external AC power 100 is supplied to the exhaust motor VM and the relay coil R, and the exhaust motor VM is operated to cause the smoke to be sucked into the exhaust path and discharged to the outside of the microwave oven.

In response to the power being supplied to the relay coil R, the first relay switch Rb1 and the second relay switch Rb2 are switched to respective turned-off states from turned-on states. The first relay contact A switch Ra1 and the second relay contact A switch Ra2 are switched to respective turned-on states from turned-off states.

Therefore, the DC power, the first relay switch Ra1, the feed motor M, the second relay switch Ra2 and the first limit switch FRONT SW form a loop. Accordingly, the feed motor M is forwardly rotated, thus enabling the guide plate 21 to move to the guide position from the initial position. In this case, the second limit switch REAR SW is switched to a turned-on state from a turned-off state according to the movement of the guide plate 21.

Thereafter, where the guide plate 21 reaches the guide position by the forward rotation of the feed motor M, the terminal of the first limit switch FRONT SW is projected and inserted into the sensing groove 26 formed in the guide plate 21. As such, the first limit switch FRONT SW is turned off. Accordingly, the supply of power to the feed motor M is shut off and the guide plate 21 is then stopped, thus enabling the guide plate 21 to guide the smoke into the exhaust path at the guide position, so as to prevent the smoke from flowing into a cooking space.

For example, where a cooking of food has been completed by the oven range, the temperature of the smoke decreases. Where the temperature of the smoke decreases to a temperature lower than a preset temperature, the thermostat T.C.O is turned off, thus shutting off the external AC power supplied to the exhaust motor VM and the relay coil R.

Accordingly, the first relay switch Rb1 and the second relay switch Rb2 are returned to the respective turned-on states from the turned-off states, while the first relay contact A switch Ra1 and the second relay contact A switch Ra2 are returned to the respective turned-off states from the turned-on states.

At this time, the second limit switch REAR SW is turned on, so the DC power, the first relay contact B switch Rb1, the feed motor M, the second relay contact B switch Rb2 and the second limit switch REAR SW form a loop. Accordingly, the feed motor M is reversely rotated, thus enabling the guide plate 21 to move to the initial position from the guide position. In this case, the first limit switch FRONT SW is turned on again.

Where the guide plate 21 reaches the initial position by the reverse rotation of the feed motor M, the terminal of the second limit switch REAR SW is pressed by the guide plate 21. As such, the second limit switch REAR SW is turned off, and the supply of power to the feed motor M is shut off, thus stopping the movement of the guide plate 21. Accordingly, the guide plate 21 is returned to the original position and a smoke guidance operation is no longer performed.

Figure 4:
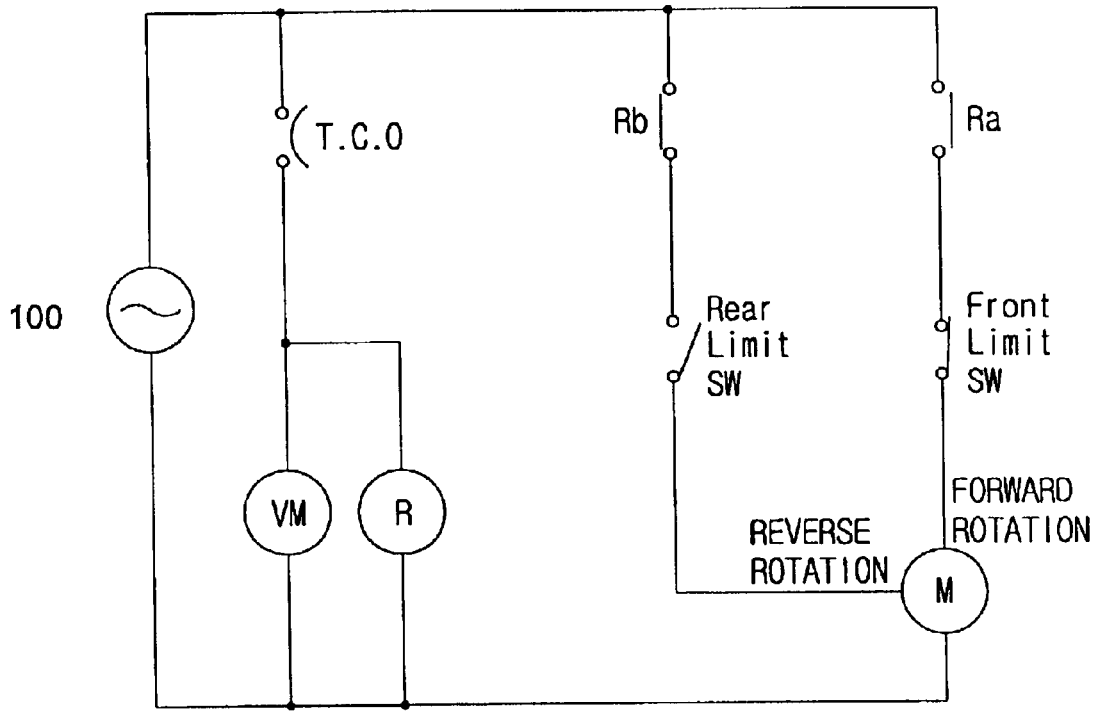
FIG. 4 is a circuit diagram of a driving circuit of a smoke guiding apparatus having an AC feed motor in a wall-mounted microwave oven according to yet another embodiment of the present invention.

FIG. 4 shows a circuit diagram of a driving circuit of a smoke guiding apparatus having an AC feed motor in a wall-mounted microwave oven according to another embodiment of the present invention. As shown in FIG. 4, one end of a thermostat T.C.O, which is turned on in response to a temperature of smoke generated therebelow, i.e., while food is cooked by an oven range, being equal to or greater than a predetermined temperature, is connected to an external AC power source 100. The other end of the thermostat T.C.O is connected to an exhaust motor VM. The exhaust motor VM receives the external AC power in response to the thermostat T.C.O being turned on, and causes the smoke to be sucked into an exhaust path of the microwave, so as to discharge the smoke to the outside of the microwave oven. The exhaust motor VM is connected in parallel with a relay coil R. The relay coil R receives the external AC power in response to the thermostat T.C.O being turned on, and turns corresponding relay switches Ra and Rb on or off.

The relay switch Ra and a first limit switch FRONT SW are disposed between one end of the external AC power source 100 and an input terminal, i.e., for a forward rotation, of the feed motor M. In this case, the relay switch Ra is turned off in a normal condition and switched to a turned-on state in response to power being supplied to the relay coil R. The first limit switch FRONT SW is connected in series with the relay switch Ra and senses the guide position of the guide plate 21.

The relay switch Rb and a second limit switch REAR SW are disposed between the one end of the external AC power source 100 and an input terminal, i.e., for a reverse rotation, of the feed motor M. In this case, the relay switch Rb is turned on in a normal condition and switched to a turned-off state in response to the power being supplied to the relay coil R. The second limit switch REAR SW is connected in series with the relay switch Rb and senses the initial position of the guide plate 21.

Hereinafter, an operation of the driving circuit of the smoke guiding apparatus shown in FIG. 4 will be described in detail.

Where a temperature of smoke generated from food, i.e., where an oven range positioned below the microwave oven is used, is equal to or greater than a predetermined temperature, the thermostat T.C.O is turned on, thus enabling the external AC power to be supplied to the exhaust motor VM and the relay coil R. Accordingly, the exhaust motor VM is operated to cause the smoke to be sucked into the exhaust path and discharged to the outside of the microwave oven.

Where power is supplied to the relay coil R, the relay switch Ra is switched to a turned-on state from a turned-off state, and the relay switch Rb is switched to a turned-off state from a turned-on state. Therefore, the AC power source 100, the relay switch Ra, the first limit switch FRONT SW and the feed motor M form a loop. Accordingly, the feed motor M is forwardly rotated, thus enabling the guide plate 21 to move to the guide position from the initial position. In this case, the second limit switch REAR SW is switched to a turned-on state from a turned-off state according to the movement of the guide plate 21.

Thereafter, where the guide plate 21 reaches the guide position by the forward rotation of the feed motor M, the terminal of the first limit switch FRONT SW is projected and inserted into the sensing groove 26 formed in the guide plate 21. As such, the first limit switch FRONT SW is turned off. Accordingly, the supply of power to the feed motor M is shut off and the guide plate 21 is then stopped, thus enabling the guide plate 21 to guide the smoke into the exhaust path at the guide position, so as to prevent the smoke from flowing into a cooking space.

For example, where a cooking of food has been completed by the oven range, the temperature of the smoke decreases. Where the temperature of the smoke decreases to a temperature lower than a preset temperature, the thermostat T.C.O is turned off, thus shutting off the external AC power supplied to the exhaust motor VM and the relay coil R. Accordingly, the relay switch Ra is returned to a turned-off state from the turned-on state, while the relay switch Rb is returned to a turned-on state from the turned-off state. At this time, the second limit switch REAR SW is turned on, so the AC power source 100, the relay switch Rb, and the second limit switch REAR SW and the feed motor M form a loop. Accordingly, the feed motor M is reversely rotated, thus enabling the guide plate 21 to move to the initial position from the guide position. In this case, the first limit switch FRONT SW is turned on again.

Where the guide plate 21 reaches the initial position by the reverse rotation of the feed motor M, the terminal of the second limit switch REAR SW is pressed by the guide plate 21. As such, the second limit switch REAR SW is turned off, and the supply of power to the feed motor M is shut off, thus stopping the movement of the guide plate 21. Accordingly, the guide plate 21 is returned to the original position and a smoke guidance operation is no longer performed.

As described above, the present invention provides a smoke guiding apparatus, which is not provided with a microcomputer to drive the smoke guiding apparatus. This reduces the entire manufacturing cost of a wall-mounted microwave oven having such a smoke guiding apparatus.

Furthermore, the smoke guiding apparatus of the present invention can also be applied to mechanical microwave ovens which are not provided with microcomputers.

Additionally, with the present smoke guiding apparatus, an AC feed motor can be used in the smoke guiding apparatus.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A controller for a smoke guiding apparatus of a wall-mounted microwave oven having an exhaust motor which discharges smoke therebelow to the outside of the wall-mounted microwave oven, a guide plate which guides the smoke, and a feed motor which moves the guide plate between an initial position and a guide position of the guide plate, the controller comprising:

a switching unit which supplies power to the feed motor so as to move the guide plate between the guide position and the initial position in conjunction with an operation of the exhaust motor driven based on a predetermined temperature of the smoke;

a first limit switch which shuts off the power supplied to the feed motor in response to the guide plate reaching the guide position; and a second limit switch which shuts off the power supplied to the feed motor in response to the guide plate reaching the initial position.

2. The controller for a smoke guiding apparatus of a wall-mounted microwave oven according to claim 1, wherein:

the guide plate includes a sensing groove for use in sensing the guide position, and the first limit switch is turned on or off with a terminal thereof projected and inserted into the sensing groove in response to he guide plate reaching the guide position.

3. The controller for a smoke guiding apparatus of a wall-mounted microwave oven according to claim 1, wherein the second limit switch is turned on or off with a terminal thereof inwardly pressed the guide plate in response to the guide plate reaching the initial position.

4. The controller for a smoke guiding apparatus of a wall-mounted microwave oven according to claim 1, wherein the switching unit comprises:

a relay coil which is supplied with external AC power in response to the exhaust motor being operated;

a plurality of first relay switches which are turned off in a normal condition of the apparatus and switched to be turned-on in response the AC power being supplied to the relay coil; and a plurality of second relay switches which are turned on in the normal condition and switched to be turned-off in response to the AC power being supplied to the relay coil.

5. The smoke guiding apparatus of a wall-mounted microwave oven according to claim 1, wherein the smoke guiding apparatus implements an operation of the guide plate without a use of a microcomputer.

6. A controller for a smoke guiding apparatus of a wall-mounted microwave oven having an exhaust motor which discharges smoke therebelow to the outside of the wall-mounted microwave oven, a guide plate which guides the smoke, and a feed motor which receives DC power nd moves the guide plate between an initial position and a guide position of the guide plate, the controller comprising:

a switching unit which supplies the DC power to the feed motor so as to move the guide plate between the guide position and the initial position in conjunction with an operation of the exhaust motor driven based on a predetermined temperature of the smoke;

a first limit switch which shuts off the DC power supplied to the feed motor in response to the guide plate reaching the guide position; and a second limit switch which shuts off the DC power supplied to the feed motor in response to the guide plate reaching the initial position.

7. The controller for a smoke guiding apparatus of a wall-mounted microwave oven according to claim 6, wherein:

the guide plate includes a sensing groove for use in sensing the guide position, and the first limit switch is turned on or off with a terminal thereof projected and inserted into the sensing groove in response to the guide plate reaching the guide position.

8. The controller for a smoke guiding apparatus of a wall-mounted microwave oven according to claim 6, wherein the second limit switch is tuned on or off with a terminal thereof inwardly pressed by the guide plate in response to the guide plate reaching the initial position.

9. The controller for a smoke guiding apparatus of a wall-mounted microwave oven according to claim 6, wherein the switching unit comprises:

a relay coil which is supplied with external AC power in response to the exhaust motor being operated;

first and second relay switches which are tuned off in a normal condition of the apparatus and switched to be turned-on in response to the AC power being supplied to the relay coil; and third and fourth relay switches which are turned on in the normal condition and switched to be turned-off in response to the AC power being supplied to the relay coil.

10. The con roller for a smoke guiding apparatus of a wall-mounted microwave oven according to claim 9, wherein:

the controller has an access to a rectifying unit of the oven which converts the AC power to provide the DC power, the first relay switch has first end thereof connected to the DC power and a second end thereof connected to a negative (−) input terminal of the feed motor, the second relay switch has a first end thereof connected to a positive (+) input terminal of the feed motor and a second end thereof connected to the first limit switch, and the feed motor is supplied with the DC power through the first relay switch, the second relay switch, and the first limit switch in response to the guide plate being moved to the guide position from the initial position.

11. The controller for a smoke guiding apparatus of a wall-mounted microwave oven according to claim 9, wherein:

the controller has an access to a rectifying unit of the oven which converts the AC power to provide the DC power, the third relay switch has first end thereof connected to the DC power and a second end thereof connected to a position (+) input terminal of the feed motor, the fourth relay switch has a first end thereof connected to a negative (−) input terminal of the feed motor and a second end thereof connected to the second limit switch, and the feed motor is supplied with the DC power through the third relay switch, the fourth relay switch, and the second limit switch in response to the guide plate being moved to the initial position from the guide position.

12. A smoke guiding apparatus of a wall-mounted microwave oven having an exhaust motor which discharges smoke therebelow to the outside of the wall-mounted microwave oven, and a guide plate which guides the smoke, the smoke guiding apparatus comprising:

a feed motor which receives AC power and moves the guide plate to an initial position or a guide position of the guide plate;

a switching unit which supplies the AC power to the feed motor so as to move the guide plate to the guide position in response to the exhaust motor being operated, and supplies the AC power to the feed motor so as to move the guide plate to the initial position in response to the operation of the exhaust motor being stopped;

a first limit switch which shuts off the AC power supplied to the feed motor in response to the guide plate reaching the guide position; and a second limit switch which shuts off the AC power supplied to the feed motor in response to the guide plate reaching the initial position.

13. The smoke guiding apparatus of a wall-mounted microwave oven according to claim 12, wherein:

the guide plate includes a sensing groove for use in sensing the guide position, and the first limit switch is turned on or off with a terminal thereof projected and inserted into the sensing groove in response to the guide plate reaching the guide position.

14. The smoke guiding apparatus of a wall-mounted microwave oven according to claim 12, wherein the second limit switch is turned on or off with a terminal thereof inwardly pressed by the guide plate in response to the guide plate reaching the initial position.

15. The smoke guiding apparatus of a wall-mounted microwave oven according to claim 12, wherein the switching unit comprises:

a relay coil which is supplied with the AC power in response to the exhaust motor being operated, and intercepted from the AC power in response to the operation of the exhaust motor being stopped;

a first relay switch which i turned off in a normal condition of the apparatus and switched to be turned-on in response to the AC power being supplied to the relay coil; and a second relay switch which is turned on in the normal condition and switched to be turned-off in response to the AC power being supplied to the relay coil.

16. The smoke guiding apparatus of a wall-mounted microwave oven according to claim 15, wherein:

the first relay switch is connected to the AC power, the first limit switch is connected in series with the first relay switch, and the feed motor is supplied with the AC power through the first relay switch and the first limit switch in response to the guide plate being moved to the guide position from the initial position.

17. The smoke guiding apparatus of a wall-mounted microwave oven according to claim 15, wherein:

the second relay switch is connected to the AC power, the second limit switch is connected in series with the second relay switch, and the feed motor is supplied with AC power through the relay contact B switch and the second limit switch in response to the guide plate being moved to the initial position from the guide position.

18. A mountable cooking apparatus comprising:

a heating unit to cook food;

a cooking chamber which receives the food;

an exhaust motor which discharges heated gas produced therebelow to the outside of the cooking apparatus; and a smoke guiding unit which guides the smoke to the exhaust motor, wherein the smoke guiding unit includes:

a guide plate which is movably provided to the smoke guiding unit, a feed motor which moves the guide plate between a guide position and a initial position of the guide plate, a switching unit which supplies power to the feed motor so as to move the guide plate to the guide position or the initial position in conjunction with an operation of the exhaust motor driven based on a predetermined temperature of the smoke, a first limit switch which shuts off the power supplied to the feed motor in response to the guide plate reaching the guide position, and a second limit switch which shuts off the power supplied to the feed motor in response to the guide plate reaching the initial position.

19. The mountable cooking apparatus according to claim 18, wherein the smoke guiding unit further includes:

guide members having corresponding guide grooves which receive the guide plate, a rack gear provided below the guide plate, and a pinion gear provided to the feed motor so as to engage the rack gear to move the guide plate.

20. The mountable cooking apparatus according to claim 18, further comprising a thermostat which is turned on in response to a temperature of the heated gas being equal to or greater than predetermined temperature, wherein the exhaust motor receives the power and operates in response to the thermostat being turned on so as to control the feed motor.

21. The mountable cooking apparatus according to claim 20, wherein the switching unit supplies the power to the feed motor so as to move the guide plate to the guide position in response to the exhaust motor being operated, and supplies the power to the feed motor so as to move the guide plate to the initial position in response to the operation of the exhaust motor being stopped.

22. The mountable cooking apparatus according to claim 18, wherein:

the feed motor comprises DC feed motor, and the smoke guiding unit further includes:

a low voltage transformer to decrease a received voltage level; and a rectifying unit which converts the power into DC power so as to have the switching unit supply the DC power to the DC feed motor.

23. The mountable cooking apparatus according to claim 18, wherein the feed motor is an AC feed motor.

24. The mountable cooking apparatus according to claim 18, wherein the smoke guiding unit implements an operation of the guide plate without a use of a microcomputer.

25. A smoke guiding apparatus of a wall-mounted microwave oven having an exhaust motor which discharges heated gas generated therebelow to the outside of the wall-mounted microwave oven, the smoke guiding apparatus comprising:

a guide plate which guides the heated gas toward the exhaust motor;

a feed motor which moves the guide plate between an initial position and a guide position of the guide plate;

a switching unit which supplier power to the feed motor so as to move the guide plate between the guide position and the initial position in conjunction with an operation of the exhaust motor driven based on a predetermined temperature of the smoke;

a first limit switch which shut off the power supplied to the feed motor in response to the guide plate reaching the guide position; and a second limit switch which shuts off the power supplied to the feed motor in response to the guide plate reaching the initial position.

* * * * *

UNITED STATES PATENT AND TRADEMARK OFFICE

CERTIFICATE OF CORRECTION

PATENT NO. : 6,765,184 B2
DATED : July 20, 2004
INVENTOR(S) : Ha-Yeong Yang

It is certified that error appears in the above-identified patent and that said Letters Patent is hereby corrected as shown below:

Column 8,
Line 8, insert -- by -- after “pressed”;
Line 31, replace “nd” with -- and --;

Column 9,
Line 5, replace “con roller” with -- controller --;
Line 10, insert -- a -- after “has”;

Column 10,
Line 13, replace “i” with -- is --;

Column 11,
Line 19, after “comprises” insert -- a --;

Column 12,
Line 18, replace “shut” with -- shuts --.

Signed and Sealed this

First Day of February, 2005

JON W. DUDAS
*Director of the United States Patent and Trademark Office*